US006237479B1

(12) United States Patent
Douba

(10) Patent No.: US 6,237,479 B1
(45) Date of Patent: May 29, 2001

(54) SERVO PRESS CONTROLLER

(75) Inventor: Eiji Douba, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/402,015

(22) PCT Filed: Mar. 31, 1998

(86) PCT No.: PCT/JP98/01474

§ 371 Date: Sep. 27, 1999

§ 102(e) Date: Sep. 27, 1999

(87) PCT Pub. No.: WO98/43803

PCT Pub. Date: Oct. 8, 1998

(30) Foreign Application Priority Data

Mar. 31, 1997 (JP) ..... 9-096752

(51) Int. Cl.[7] ..... B30B 15/14; B30B 15/26
(52) U.S. Cl. ..... 100/43; 100/48
(58) Field of Search ..... 100/43, 48, 99, 100/342, 343

(56) References Cited

U.S. PATENT DOCUMENTS 5,813,322 * 9/1998 Kuroda ..... 100/43
5,829,347 * 11/1998 Hiruma ..... 100/43
5,965,994 * 10/1999 Seo .

FOREIGN PATENT DOCUMENTS

| | | |
|---|---|---|
| 3-35898 | 2/1991 | (JP) . |
| 3-33439 | 5/1991 | (JP) . |
| 6-114600 | 4/1994 | (JP) . |
| 7-290300 | 11/1995 | (JP) . |
| 8-90299 | 4/1996 | (JP) . |

* cited by examiner

*Primary Examiner*—Stephen F. Gerrity
(74) *Attorney, Agent, or Firm*—Sidley & Austin

(57) ABSTRACT

The present invention relates to a servo press controller which can prevent the servo runaway caused by the malfunction of CPUs, the faults of a position sensor, or other troubles to thereby increase the safety of the servo press. For this purpose, first to third CPUs (21, 22, 23) each of which conducts a different control among the input of set data, the calculation of a servo position command, and the calculation of a servo speed command send and receive watch dog signals between itself and another CPU for monitoring each other's condition by checking whether the watch dog signals sent from the partner computer are normal or not, and, when there is an abnormality in any computer, stopping the servo press (1) for emergency.

5 Claims, 3 Drawing Sheets

SERVO PRESS CONTROLLER

TECHNICAL FIELD

The present invention relates to a controller for a press in which a slide is rectilinearly driven by an electric servo motor, that is, a so-called servo press.

BACKGROUND ART

In recent years, a rectilinear motion-type press (hereinafter referred to as a servo press) in which a slide is rectilinearly driven by an electric servo motor such as an AC servo motor or the like is used in many fields. The reason for the above is that compared with conventional mechanical presses, the servo press has advantages of being able to operate with freer slide motion at higher speed and to easily control pressure, thus enabling a higher degree of forming and improving productivity. Further, as compared with oil hydraulic presses, the servo press has advantages of providing lower noise, lower vibration, and higher energy saving, being clean without oil leakage, and being able to start and stop a slide extremely in a short time, thus improving working environment, productivity, and the like.

Known as a controller for such a servo press is a servo press controller disclosed in Japanese Patent Publication No. 3-33439 which shows a controller which operates predetermined servo calculation processing with one computer unit (hereinafter called CPU) as a core, outputs the servo command to a servo pack (a so-called servo amplifier) to control the position and speed of a servo motor, and rectilinearly drives a ram (a slide) with the stroke thereof being within a previously set range.

In the aforesaid conventional servo press controller, however, there occur disadvantages regarding safety described below.

1) When a CPU chip malfunctions, for example, due to thermal runaway, abnormalities in power supply voltage, or electrical noise, the maximum value of speed command or position command is sometimes outputted. Thereby, there is the possibility that so-called servo runway occurs, whereby the ram abruptly operates at high speed in an unexpected direction.

2) Further, when a ram position sensor breaks down, some electrical noise is intermingled with a signal line of the position sensor, or a contact failure in a input connector of position signals and the like occurs, there is the possibility that the position control of the ram becomes impossible, thereby producing servo runaway.

3) Furthermore, when the control software of the CPU malfunctions due to some program error and the like and so-called software runaway occurs, there is also the possibility that servo runaway occurs.

DISCLOSURE OF THE INVENTION

The present invention is made in view of the aforesaid disadvantages, and its object is to provide a servo press controller which can prevent servo runaway caused by the malfunction of CPUs for controlling a servo, the fault of a position detector, and the like and has a higher level of safety.

A servo press controller according to the present invention is a servo press controller which drives a slide supported on a frame to be rectilinearly movable by a servo motor to thereby conduct press working characterized by including an operation input element which inputs press operation signals including an operation mode and an operation starting signal for a press by means of manipulation of an operation switch by an operator or communication from the outside, and outputs the inputted press operation signals, a first CPU which previously stores set data including motion data of the slide and starting conditions of the press, outputs the stored set data at the time of press starting, and decides whether press starting is possible or not based on the stored set data and the press operation signals inputted from the operation input element to thereby output a press starting signal, a second CPU which decides that press starting is possible based on the set data inputted from the first CPU and the press operation signals inputted from the operation input element, and calculates and outputs a position command of the servo motor based on the motion data in the set data at least when the press starting signal shows that press starting is possible, a first position sensor for detecting the position of the slide, a second position sensor for detecting the rotational position of the servo motor, a third CPU which inputs position signals from at least either of the first position sensor or the second position sensor, and calculates and outputs a speed command with at least one of the inputted position signals as a position feedback signal, based on a position deviation between the position command from the second CPU and the position feedback signal, and a servo amplifier for controlling a driving current of the servo motor in such a manner that a speed deviation between the speed command inputted from the third CPU and a speed feedback value of the servo motor calculated based on the position signal inputted from the second position sensor decreases, the first to third CPUs having the function of sending and receiving watch dog signals at least either of between the first CPU and the second CPU, or between the second CPU and the third CPU to thereby check whether the partner CPU is in normal operation, and having the function that when one CPU is judged to be abnormal by the check, the partner CPU stops the press for emergency.

According to the above configuration, a plurality of (for example, three) CPUs provided in the controller respectively conduct different processing related to servo press control (the input of set data, the calculation of a servo position command, the calculation of a servo speed command, and the like) and monitor an abnormality in each other's computer. Specifically, two CPUs mutually send and receive watch dog signals to thereby check whether the watch dog signal sent from the partner CPU is normal or not, and thus it is confirmed whether the partner CPU is in normal operation or not. In this case, when it is decided that the partner CPU has a computer abnormality, the press is stopped for emergency, thus preventing the abnormal operation of the slide caused by servo runaway. The decision whether press starting is possible or not is performed by two CPUs (for example, for the input of set data and for the calculation of a servo position command), and only when both CPUs decide that the starting is possible, the press can be started, thereby eliminating the possibility that the press is wrongly started due to the braking of a signal line, a contact failure, noise, the fault of an input circuit, or the like. Accordingly the safety of the servo press can be further improved.

Further, respective software languages for the first CPU and the second CPU may be different.

According to the aforesaid configuration, the software for the first CPU (for the input of the set data) and the second CPU (for the calculation of a servo position command) is described in different languages, for example, a Programming Language C and a ladder sequence language, which eliminates the possibility that the similar bugs (troubles such as a program error and the like) occur in the software of both CPUs. Accordingly, it is prevented that both the CPUs have computer abnormalities at the same time, and either one normal CPU can surely detect the computer abnormality of the other CPU to thereby stop the press for emergency by the monitoring function by means of the aforesaid watch dog signals. As a result, servo runaway and the like are prevented, thereby greatly improving safety.

Furthermore, respective computers of the first CPU and the second CPU may be different in at least either of CPU chip model number or CPU chip manufacturer.

According to the aforesaid configuration, the respective computers of the first CPU (for the input of the set data) and the second CPU (for the calculation of a servo position command) are different in CPU chip model number or manufacturer, which eliminates the possibility that both CPU chips simultaneously get in thermal runaway or software runaway. Accordingly, both the CPUs can be prevented from having computer abnormalities at the same time, and either one normal CPU can surely detect the computer abnormality of the other CPU to thereby stop the press for emergency by the monitoring function by means of the aforesaid watch dog signals. As a result, servo runaway and the like are prevented, thereby greatly improving safety.

Moreover, it is possible that the third CPU inputs position signals respectively from the first position sensor and the second position sensor, calculates respective position data of the slide based on the inputted respective position signals, and checks abnormalities in the first position sensor and the second position sensor based on a difference between the calculated respective position data.

According to the aforesaid configuration, in the case where two position sensors with different purposes of use are provided, both the slide position data derived from the position signals from the two position sensors are compared, and when a difference between both the slide position data exceeds a predetermined allowable value, it is decided that the fault, breakage, breaking of a signal line, or the like of either one position sensor exists. For example, two position sensors may be the first sensor in which a rotational position pulse of the servo motor is detected to be used for speed feedback or for position feedback during high speed control, and the second sensor in which a slide moving position is precisely detected to be used for position feedback during low speed control. Accordingly, abnormalities in a position sensor are certainly detected, in which case the press is stopped for emergency, thereby preventing the occurrence of servo runaway during the control of the servo motor by the position signal of the above position sensor. Consequently, the safety of the servo press can be improved.

In addition, respective input power supply lines or power supply voltages of the first CPU and the second CPU may be different.

According to the aforesaid configuration, input power supply lines of at least the first CPU (for the input of the set data) and the second CPU (for the calculation of a servo position command) are respectively connected to different power supply lines (provided that power supply voltages are the same), or power supply voltages are different, for example, 100V AC and 200V AC, which allows environmental conditions of the power supply lines of both CPUs to differ from each other and enables the intermingled levels of noise and the influence of power supply voltage fluctuations to differ between both CPUs. Thus, the possibility that the voltages of the power supply lines of both the CPUs lower at the same time, thereby causing computer runaway or both the CPUs concurrently malfunctions due to noise in power supply lines is eliminated. Hence, simultaneous malfunction of both the CPUs is prevented, and either one normal CPU can surely detect the computer abnormality of the other CPU to thereby stop the press for emergency by the monitoring function by means of the aforesaid watch dog signals. As a result, servo runaway and the like are prevented, thereby greatly improving safety.

BEST MODE FOR CARRYING OUT THE INVENTION

A preferred embodiment according to the present invention will be described below with reference to the drawings.

Figure 1:
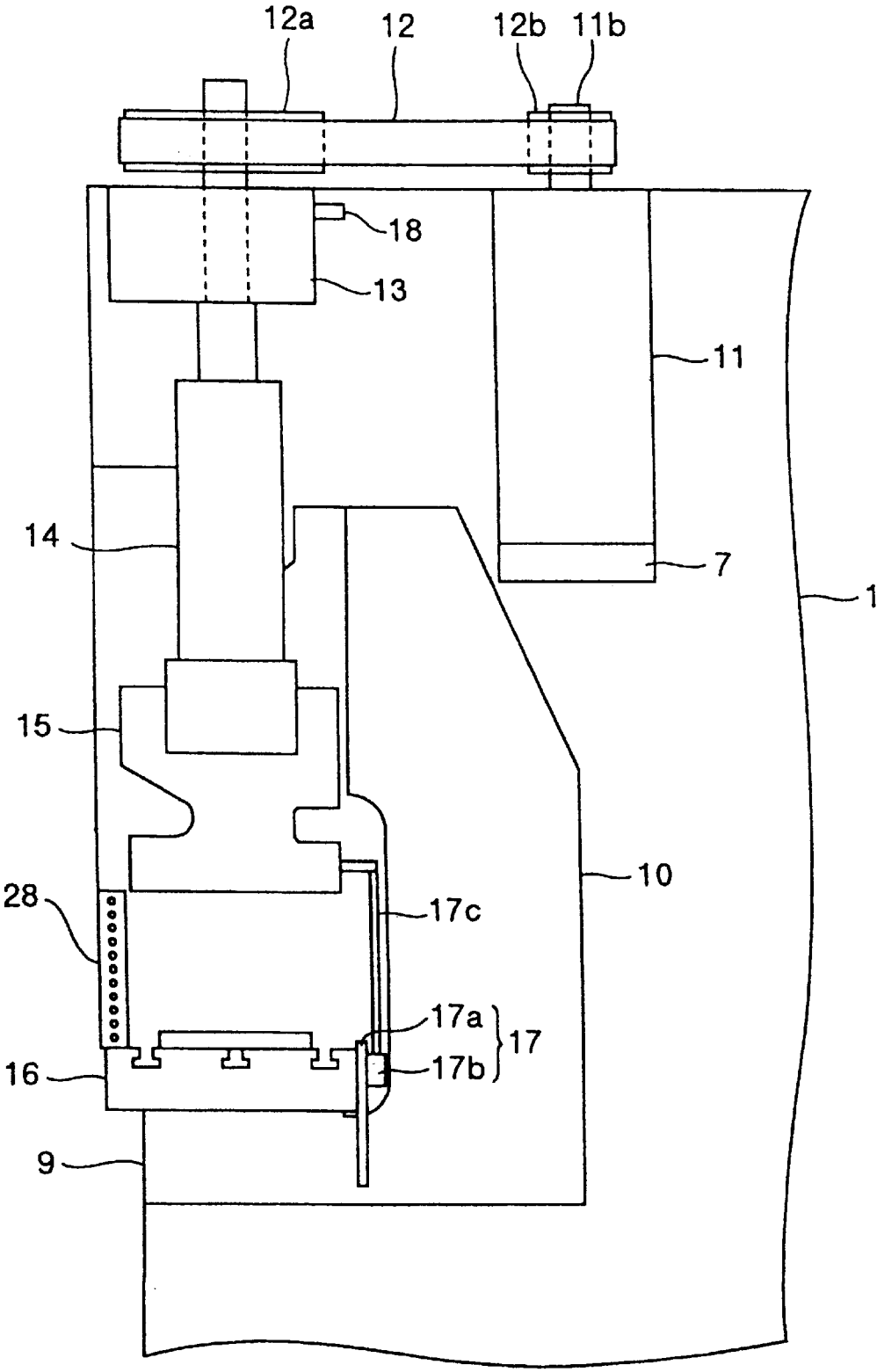
FIG. 1 is a side view of a principal portion showing an example of a servo press according to the present invention.

In FIG. 1, a bed 9 is provided at the lower portion of the front face of a frame 10 of a main body of a servo press 1, and a bolster 16 is provided on the upper portion of the bed 9. A power converter 14 composed of, for example, a ball screw or the like for converting rotation into vertical rectilinear motion is disposed at the upper portion of the frame 10. A slide 15 is placed to be vertically movable at the lower end of a rectilinearly moving portion (a nut portion of a ball screw device, for example) of the power converter 14 and at a position opposite the bolster 16. The upper end portion of a rotating portion (a ball screw portion of the ball screw device, for example) of the power converter 14 is connected to an output rotating shaft 11*b* of a servo motor 11 via a rotation transmitting member 12. In the present embodiment, as shown, a belt (referred to as a belt 12 hereinafter) is used as an example of the rotation transmitting member 12. A belt pulley 12*a* and a belt pulley 12*b* each engaging with the belt 12 are attached respectively to the upper end portion of the aforesaid rotating portion of the power converter 14 and the output rotating shaft 11*b* of the servo motor 11. As described above, the slide 15 is vertically driven by the rotation of the servo motor 11. With the vertical drive of the slide 15, press working is conducted between a lower die (not shown) provided on the upper face of the bolster 16 and an upper die (not shown) provided on the lower face of the slide 15.

A first position sensor 17 composed of a linear sensor including a linear scale and the like is disposed between the rear end portion of the bolster 16 and the rear end portion of the slide 15. In the present embodiment, the first position sensor 17 consists of a detection head 17*b* attached to the lower end portion of a slender rod 17*c*, of which the upper end is supported by the rear portion of the slide 15 and the axial direction is parallel to the movement direction of the slide 15 (a vertical direction in this case), and a linear scale 17*a* slidably engaging with the detection head 17*b* while maintaining a predetermined distance therefrom. Following the vertical motion of the slide 15, the detection head 17*b* vertically moves relative to the linear scale 17*a*, and thus the position of the slide 15 is detected by its height from the upper face of the bolster 16 through a position detecting element inside the linear scale 17*a* by a light signal from the detection head 17*b*. A position signal of the slide 15 detected by the first position sensor 17 is inputted into a third CPU 23 which conducts servo calculation processing described later. The third CPU 23 drives the servo motor 11 in accordance with the position signal to control the position of the slide 15 in such a way that the position is on a predetermined motion curve.

A second position sensor 7 such as a pulse encoder or the like is attached to the opposite side to the output rotating shaft 11*b* of the servo motor 11 and coaxially with the rotating shaft 11*b*. The second position sensor 7 detects the rotation angle of the servo motor 11 as the slide position and is also used for the detection of motor rotating speed. A position pulse signal from the second position sensor 7 is inputted to the third CPU 23 and a servo amplifier 25 both of which are described later. It should be noted that the servo motor 11 may be composed of either of an AC servo motor or a DC servo motor.

A mechanical brake 13 is attached to the rotating portion (for example, a ball screw or the like) of the power converter 14, and allows power transmission of the power converter 14 to be stopped, thereby stopping the slide 15. Supply power voltage to the mechanical brake 13 is turned off by a brake command from each CPU which is described later to thereby operate the brake. A brake operation sensor 18 is provided in the mechanical brake 13 to confirm the mechanical operating state of the mechanical brake 13. Incidentally, the brake operation sensor 18 can be composed of, for example, a proximity switch, a limit switch, or the like. A detection signal from the brake operation sensor 18 is inputted into each CPU described later.

Photoelectric type sensing safety devices 28 are provided on either side of the front face portion of the operating range of the slide 15. When something to invade from the front face side of the servo press 1 into the aforesaid operating range shades the optical axis of the photoelectric type sensing safety device 28, a light block signal is outputted to a quick stop circuit of a control circuit which is described later.

Figure 2:
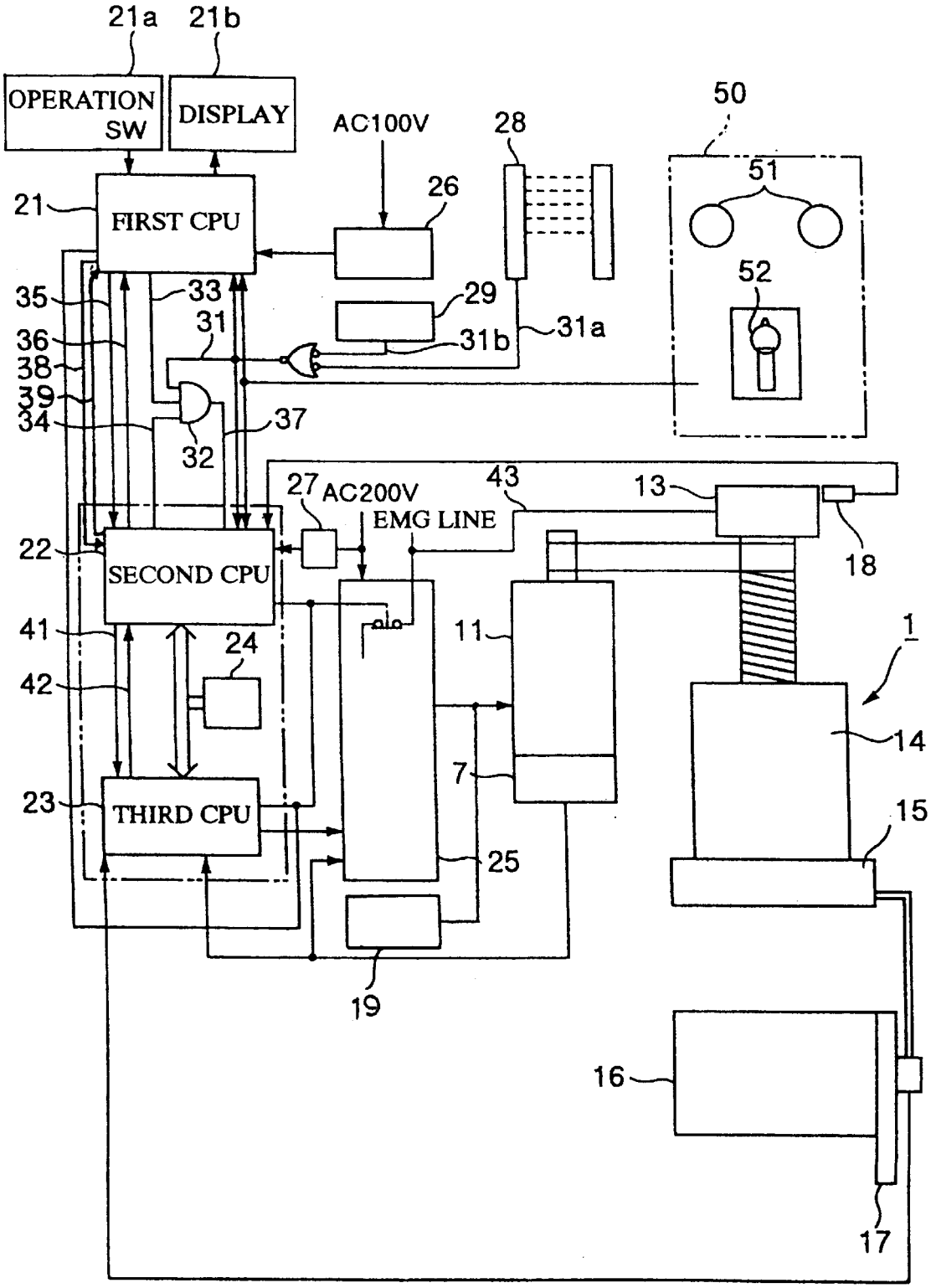
FIG. 2 is a control circuit block diagram of a servo press controller according to the present invention.

Next, the control circuit according to the present embodiment is described based on a control circuit block diagram shown in FIG. 2.

A controller for the servo press 1 according to the present invention includes two different systems of CPUs for conducting the control of starting/stopping of the press, that is, a first CPU 21 and a second CPU 22. Input power supplies of the respective CPUs 21 and 22 are supplied with power supply lines with different voltages. In the present embodiment, for example, the first CPU 21 is supplied with a 100V AC line and the second CPU 22 is supplied with a 200V AC line. DC power supply units 26 and 27 are separately provided for the CPUs 21 and 22 as DC power supplies for operating computers. The DC power units 26 and 27 are connected respectively to the aforesaid input power supply lines with different voltages. It is desirable that the power supplies with different voltages are different in electrical environmental conditions such as power supply noise, power supply voltage fluctuation, and the like. Incidentally, it is suitable that even when power supply voltages are the same, the power supply voltages are supplied from separate power supply lines which are different in electrical environmental conditions.

An operation input element 50 inputs press operation signals such as an operation mode (a production mode, a data setting mode, or the like), an operation starting signal, and the like of the press, and outputs these press operation signals to the aforesaid two systems of computers, that is, the first CPU 21 and the second CPU 22. The operation input element 50, for example, may consist of an operation mode switch 52, an operation starting switch 51, and the like which are provided on an operation panel shown, or may input the aforesaid press operation signals by data communication from other controllers and the like.

The first CPU 21 mainly has a function of previously inputting and storing set data such as motion data (data for specifying the motion, for example, representing the data of the uppermost position, lowermost position, lowering speed, lifting speed, pressurization starting position, applied pressure, and the like) of the slide 15, press starting conditions, and the like. The first CPU 21 includes an operation switch 21*a* for inputting the set data and a display 21*b* for displaying the set data and control information data showing a control state inside the first CPU 21 and the like, wherein the first CPU 21, for example, may be composed of a standard computer unit provided with a keyboard and a display, or may be composed of a so-called panel computer unit in which transparent touch-keys are closely attached to a display portion at the front face of a graphic display, a character display, or the like. After storing the aforesaid inputted set data in a predetermined memory, the first CPU 21 outputs the stored set data to the second CPU 22 via data communication 38 such as parallel communication, serial communication, or the like. Moreover, when the aforesaid operation starting signal from the operation input element 50 is switched on to thereby start press operation, the first CPU 21 decides whether press starting is possible or not, based on the inputted press operation signals and slide position information inputted from the second CPU 22 via data communication 39 such as parallel communication, serial communication, or the like. If the result of this decision shows that press starting is possible, a press starting signal 33 is switched on (set at a high level) to be outputted to an AND circuit 32 of a quick stop circuit. The first CPU 21 always outputs a watch dog signal 35 to the second CPU 22 while being in normal operation.

The second CPU 22 mainly conducts rough calculation processing of a control command value of the servo motor 11 which drives the slide 15. The second CPU 22 always inputs the aforesaid press operation signals from the press operation input element 50 similarly to the first CPU 21, and inputs the aforesaid set data from the first CPU 21 as well. When the aforesaid operation starting signal from the operation input element 50 is switched on to thereby start press operation, the second CPU 22 decides whether press starting is possible or not, based on the aforesaid set data, the press operation signals being inputted at present, and slide position information being inputted from the third CPU 23. If the result of this decision shows that press starting is possible, a press starting signal 34 is switched on (set at a high level) to be outputted to the AND circuit 32 of the quick stop circuit. In addition, when a high level of a starting command 37 is inputted from the AND circuit 32, in order that the slide 15 is driven along a motion curve based on the aforesaid set data, the second CPU 22 calculates a position command at every approximate point (that is, PTP position command) on the motion curve or a torque command corresponding to the aforesaid set applied pressure. Incidentally, the position command is calculated, for example, as a position on the motion curve at intervals of predetermined period of time or predetermined distance. The calculated position command or torque command is written in a dual port memory 24 and outputted to the third CPU 23 via the dual port memory 24.

Further, the second CPU 22 always outputs a watch dog signal 36 to the first CPU 21 and a watch dog signal 41 to the third CPU 23.

Furthermore, a light block signal 31*a* from the photoelectric type sensing safety device 28 or an OR signal such as a quick stop signal 31*b* from a peripheral device 29, for example, a raw material transfer device or the like (namely, either one of quick stop requesting signals) is inputted as an outside quick stop requesting signal 31 to the AND circuit 32 of the quick stop circuit, and in addition to the first CPU 21 and the second CPU 22. When the outside quick stop requesting signal 31 is at a low level, the CPUs 21 and 22 output the outside quick stop requesting signal 31 while switching the press starting signals 33 and 34 off (setting them at a low level), in which case the outside quick stop requesting signal 31 such as the light block signal 31*a* or the quick stop signal 31*b* is set at a low level when a quick stop is required.

The AND circuit 32 of the quick stop circuit inputs the press starting signal 33 from the first CPU 21, the press starting signal 34 from the second CPU 22, and the outside quick stop requesting signal 31. Only when all these input signals are at a high level, that is, only when both the press starting signals 33 and 34 indicate "starting is possible" and outside quick stop request is "not required", the AND circuit 32 outputs a high level of the starting command 37 to the second CPU 22.

The dual port memory 24 is a bidirectional memory capable of reading and writing in two directions of the second CPU 22 and the third CPU 23. When the aforesaid PTP position command data or the torque command data is transmitted from the second CPU 22 to the third CPU 23, or when the slide position data (information) is transmitted from the third CPU 23 to the second CPU 22, these transmit data (for example, the position command data or the torque command data, the slide position data, and the like), and the parity bits of the transmit data are written into the dual port memory 24. When reading the above data, the third CPU 23 conducts a parity check thereon, and only when the check is approved, the position command data or the torque command data is available.

The third CPU 23 inputs the position command data or the torque command data and also inputs a position signal from the first position sensor 17 and a position signal from the second position sensor 7. While conducting position control along the motion curve, the third CPU 23 performs calculation processing with either of the aforesaid two position signals as a position feedback signal. As for the above selection of a position signal, for example, suppose that the first position sensor 17 is a position sensor with high-precision resolution and the second position sensor 7 is a position sensor with relatively rough resolution. A position signal from the second sensor 7 is fed back for control during high speed movement, and a position signal from the first position sensor 17 is fed back for the precise position control during low speed working. In the above cases, the position command data of a still shorter time interval or distance interval between the approximate points are calculated by linear interpolation based on the aforesaid available position command data. Subsequently, a speed command value is calculated in such a manner that a position deviation between the derived position command data and either one position feedback signal out of the aforesaid two position signals decreases, and is outputted to the servo amplifier 25.

Alternatively, in the case of controlling applied pressure, the third CPU 23 calculates a current command value according to the aforesaid torque command data and outputs the calculated current command value to the servo amplifier 25. Moreover, the third CPU 23 always outputs a watch dog signal 42 to the second CPU 22 while being in normal operation.

In response to the aforesaid speed command value or current command value, the servo amplifier 25 controls the driving current of the servo motor 11 and rotates the servo motor 11 at predetermined speed or output torque according to the aforesaid command. At this time, when inputting the speed command value, the servo amplifier 25 controls a motor driving current in such a manner that a speed deviation between the speed command value and speed data derived by a position pulse signal from the second position sensor 7 decreases. Alternatively, when inputting a torque command value, the servo amplifier 25 controls the motor driving current so that a current deviation between the torque command value and a current signal from a current sensor not shown decreases.

Supply voltage (for example, 24V DC) is usually applied to a solenoid valve for actuating the mechanical brake 13 via an emergency stop signal line 43. Each of the CPUs 21, 22, and 23 detects, for example, a computer abnormality or the like, conducts emergency stop processing, and then outputs a brake command, whereby supply voltage to the aforesaid solenoid valve is turned off and the mechanical brake 13 is then operated. At this time, the brake operation sensor 18 is switched on to output a brake operating signal to each CPU (the second CPU 22 in FIG. 2), which enables the confirmation of the operation of the mechanical brake 13.

A dynamic brake unit 19 is connected to a motor output line for the connection between the servo amplifier 25 and the servo motor 11. The dynamic brake unit 19 is provided with a predetermined resistance, for example. The moment that the mechanical brake 13 is operated by the aforesaid brake command from each CPU, the motor output line from the servo amplifier 25 is cut off from the servo motor 11 and an output terminal of the servo motor 11 is connected to the aforesaid resistance of the dynamic brake unit 19. Hence, in emergency stop, a dynamic brake is actuated by consuming regenerative energy during coasting rotation of the servo motor 11 by the resistance, thus reducing the stopping distance of the servo motor 11.

Figure 3:
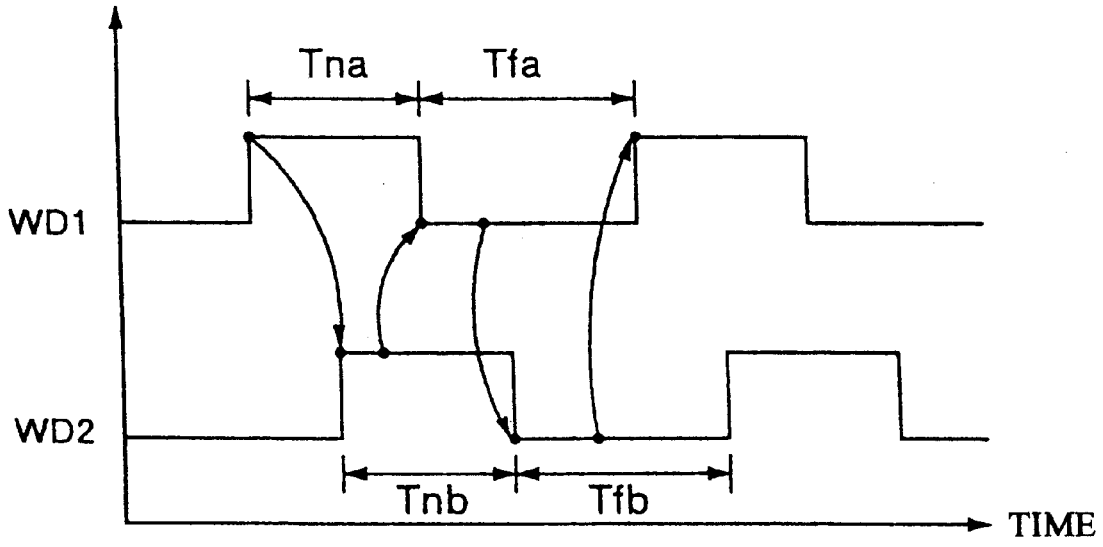
FIG. 3 is explanatory diagram of watch dog signals according to the present invention.

Next, the operation based on the above configuration will be described. The first CPU 21 and the second CPU 22, and the second CPU 22 and the third CPU 23 monitor whether or not each other's partner computer is in normal operation. For this purpose, the CPUs output the aforesaid watch dog signals between one CPU and the partner CPU. FIG. 3 shows an example of the watch dog signals. In FIG. 3, watch dog signals WD1 and WD2 represent the watch dog signals of two CPUs which monitor each other. Software for each CPU is incorporated in such a way that after it is confirmed that the level of the watch dog signal of the partner CPU is reversed (for example, a low level to a high level, or a high level to a low level), the level of its own watch dog signal is reversed. Therefore, the watch dog signals WD1 and WD2 are, as shown, rectangular repeat signals such that the high level period of one signal and the low level period of the other signal overlap with each other at predetermined time intervals. In this case, supposing that each CPU is in normal operation without runaway, respective time intervals Tna and Tnb of the high level periods and time intervals Tfa and Tfb of the low level periods of the watch dog signals WD1 and WD2 are not more than a predetermined allowable time interval ta, based on the processing time required for reversal processing of a watch dog signal according to software in each CPU.

If any one of the CPUs gets into computer runaway due to some cause such as soft runaway or the like, the watch dog signal of this CPU is not reversed. Thus the time interval of the high level period or the time interval of the low level of the above watch dog signal becomes longer than the predetermined allowable time interval ta. Consequently, one CPU can decide that there is a computer abnormality in the other CPU when either of the time interval of the high level period or the time interval of the low level period of the watch dog signal of the other CPU exceeds the predetermined allowable time interval ta. When there occurs an abnormality in any computer, at least any one of the other CPUs can stop the press for emergency. When the press is stopped for emergency, each CPU outputs a brake command to thereby turn off the supply power voltage of the mechanical brake 13, thus operating the brake, and at the same time outputs a servo stop command to the servo amplifier 25, thus operating the dynamic brake. Accordingly, the press can be certainly stopped. As a result, the servo runaway of the slide 15 caused by a computer abnormality can be prevented, thereby improving safety.

When the press operation starts, two CPUs, that is, the first CPU 21 and the second CPU 22 separately check whether input conditions of respective operation signals which enable the starting of the press are satisfied, whether the quick stop request signals from the peripheral device 29, the photoelectric type sensing safety device 28, and the like are inputted, and the like. Only when both the CPUs decide that press starting is possible, the press is started. Thus, even if there occur erroneous inputs of respective operation signals or input circuits of the aforesaid operation signals of respective CPUs break down, the wrong starting of the servo press 1 can be prevented by the circuit of either one of the CPU systems.

Input power supplies of the first CPU 21 and the second CPU 22 are connected to separate power supply lines with different power supply voltages and power supply environment conditions, which eliminates the possibility that both the CPUs simultaneously run away, for example, due to noise, power supply voltage fluctuation, and the like. Thereby at least either one normal CPU can monitor the runaway of the other CPU, thus preventing slide runaway caused by a computer abnormality, and improving safety.

The control software for the first CPU 21 and the second CPU 22 is described in different languages. For example, the software for the first CPU 21 and the software for the second CPU 22 are described respectively in a Programming Language C and a ladder sequence language, and are different in combination of control programs, which eliminates the possibility that similar bugs (troubles such as an program error and the like) occur in the programs of both the CPUs. Thus, when processing is conducted on the same input conditions and input data, both CPUs can be prevented from simultaneously having computer abnormalities due to these bugs.

The computers used for the both CPUs 21 and 22 use CPU chips with different model numbers or manufactures. Specifically, since CPU chips with the same model numbers or manufactures have the same manufacturing processes, they tend to have similar temperature characteristics, performances, functional characteristics, and the like in terms of hardware. In this case, there is a large possibility that thermal runaway of computers caused by an increase in temperature, for example, concurrently occurs, or computer runaway due to troubles in designing or manufacturing the CPU chips simultaneously occurs. In order to prevent this, the CPU chips with different model numbers and manufactures are used as described above, which makes it possible that at least either one CPU surely detects the abnormalities of the other CPU, thus improving safety.

The transmission of position command data or torque command data between the second CPU 22 and the third CPU 23 both of which conduct servo calculation processing is performed, appending parity, via the dual port memory 24. Thus, even in the case of wrong transmission, the wrong transmission can be certainly detected. Only when the transmission is judged to be normal by a parity check, the servo calculation is conducted based on the position command data or the torque command data, and hence the servo motor 11 is controlled. As a result, servo runaway caused by wrong transmission is eliminated.

The third CPU 23 inputs position signals from two different position sensors, that is, the first position sensor 17 and the second position sensor 7, calculates respective slide position data based on the above position signals, and compares both the slide position data with each other. When a difference between the two slide position data exceeds a predetermined allowable value, it is decided that there occur the fault, breakage, breaking of a signal line, and the like of either one position sensor, thereby stopping the press for emergency. Consequently, servo runaway caused by the feedback abnormality of any position signal can be prevented, further improving safety. Moreover, a position deviation between a desired value of the position command and the position feedback signal of either of the aforesaid position sensors is always monitored, and when the above position deviation exceeds a predetermined position deviation allowable value, it is determined that there occurs servo runaway caused by noise, the breaking of any position signal line, and the like, and the servo press is stopped for emergency, which leads to a higher level of safety.

As explained above, a plurality of CPUs separately conduct more than one different type of processing related to the control of the servo press 1, for example, the input of set data, the calculation of a servo position command, and the calculation of a servo speed command. The respective CPUs mutually monitor the occurrence of a computer abnormality in their partner CPU. When a computer abnormality occurs in any one of CPUs, the normal partner CPU stops the press for emergency. In this case, software languages, model numbers and manufactures of CPU chips, or input power supply lines or power supply voltages differ between two CPUs, thereby eliminating the possibility that both the CPUs simultaneously get into malfunction or computer runaway, thus improving safety. By comparing both position data which are respectively derived by position signals from two different slide position sensors, the faults of both the position sensors and the braking of signal lines can be certainly detected, thus preventing the servo runaway caused by the abnormality of the position feedback signal.

Industrial availability

The present invention is useful as a servo press controller which can prevent the servo runaway caused by the malfunction of CPUs for controlling a servo, the fault of a position sensor, and other troubles and has a higher level of safety.

What is claimed is:

1. A servo press controller which drives a slide supported on a frame to be rectilinearly movable by a servo motor to thereby conduct press working, said servo press controller comprising:

an operation input element which inputs press operation signals including an operation mode and an operation starting signal for a press by means of manipulation of an operation switch by an operator or communication from the outside, and outputs said inputted press operation signals;

a first CPU which previously stores set data including motion data of said slide and starting conditions of the press, outputs said stored set data at the time of press starting, and decides whether press starting is possible or not based on said stored set data and the press operation signals inputted from said operation input element to thereby output a press starting signal;

a second CPU which decides that press starting is possible based on the set data inputted from said first CPU and the press operation signals inputted from said operation input element, and calculates and outputs a position command of said servo motor based on the motion data in said set data at least when said press starting signal shows that press starting is possible;

a first position sensor for detecting the position of said slide;

a second position sensor for detecting the rotational position of said servo motor;

a third CPU which inputs position signals from at least either of said first position sensor or said second position sensor, and calculates and outputs a speed command with at least one of said inputted position signals as a position feedback signal, based on a position deviation between the position command from said second CPU and said position feedback signal; and a servo amplifier for controlling a driving current of said servo motor in such a manner that a speed deviation between the speed command inputted from said third CPU and a speed feedback value of said servo motor calculated based on the position signal inputted from said second position sensor decreases, wherein said first to third CPUs have the function of sending and receiving watch dog signals at least either of between said first CPU and said second CPU, or between said second CPU and said third CPU to thereby check whether the partner CPU is in normal operation, and have the function that when one CPU is judged to be abnormal by said check, the partner CPU stops the press for an emergency.

2. The servo press controller in accordance with claim 1, wherein respective software languages for said first CPU and said second CPU are different.

3. The servo press controller in accordance with claim 1, wherein respective computers of said first CPU and said second CPU are different in at least either of CPU chip model number or CPU chip manufacturer.

4. The servo press controller in accordance with claim 1, wherein said third CPU inputs respective position signals from said first position sensor and said second position sensor, calculates respective position data of said slide based on said inputted respective position signals, and checks abnormalities in said first position sensor and said second position sensor based on a difference between said calculated respective position data.

5. The servo press controller in accordance with any one of claim 1, claim 2, or claim 3, wherein respective input power supply lines or power supply voltages of said first CPU and said second CPU are different.

* * * * *